United States Patent [19]

Sevillano et al.

[11] 4,180,142

[45] Dec. 25, 1979

[54] EMERGENCY ESCAPE OPENABLE SKYLIGHT

[76] Inventors: Richard Sevillano, 611 Reach St.; Rocco Bruno, Jr, 847 Foulkrod St., both of Philadelphia, Pa. 19111

[21] Appl. No.: 909,733

[22] Filed: May 25, 1978

[51] Int. Cl.[2] ..... E04F 11/04; E06B 5/00

[52] U.S. Cl. ..... 182/77; 182/81; 182/196

[58] Field of Search ..... 182/77–81, 182/196–199; 49/7

[56] References Cited

U.S. PATENT DOCUMENTS

| | | | |
|---|---|---|---|
| 242,716 | 6/1881 | Thompson | 182/77 |
| 877,363 | 1/1908 | Nielsen | 182/81 |
| 3,561,162 | 2/1971 | Goldman | 49/7 |
| 3,807,528 | 4/1974 | Frank | 182/181 |

FOREIGN PATENT DOCUMENTS

| | | | |
|---|---|---|---|
| 17475 | of 1902 | United Kingdom | 182/81 |

*Primary Examiner*—Reinaldo P. Machado
*Attorney, Agent, or Firm*—Michael F. Petock

[57] ABSTRACT

An emergency escape openable skylight is provided with a resiliently biased openable cover with at least a substantial portion of the openable cover being constructed of a transparent material. The skylight is provided with a retractable ladder. The retractable ladder may be a pully operated flexible ladder, a rigid foldable ladder, or any other suitable retractable ladder. The cover is normally held closed by a latch means, but is self-opening or substantially self-opening upon release of the latch by reason of the resilient biasing means.

1 Claim, 5 Drawing Figures

10
12
14
16
18
20
22
24
26
28
30
31
32
34
36
38
40
42
44
46
48
50
52
54
56
58
63
66
68
70
72
74
76
78
80
82
84
86
88
3

EMERGENCY ESCAPE OPENABLE SKYLIGHT

BACKGROUND OF THE INVENTION

The present invention relates to an emergency escape openable skylight. More particularly, the present invention relates to an emergency escape openable skylight in which the skylight functions both to admit ambient light and ventilation, and functions as an emergency escape route, as well as a means of conveniently getting on the roof for various purposes such as cleaning gutters, adjusting the television antenna, etc.

Skylights have been known in the prior art. Many homes, especially in urban areas, have been built with skylights or have had skylights added to them to provide additional sunlight in the dwelling. This is especially so in homes which are sometimes referred to as "row houses" where the number of windows in the home have been limited by reason of constructions utilizing party walls.

There has been a trend to become more aware of and to try to prevent the horrible injuries and deaths which occur from fires in the home. In recent years, there has been a tremendous upsurge in the availability and use of detectors which detect fires at a relatively early stage. However, as happens too frequently, a person may be alerted to a fire only to find that his route of escape has been cut off by smoke or flames or a combination of both. This is an especially acute problem in row houses which typically do not have windows on two sides of the building.

Although skylights have been known in the past, openable skylights with retractable ladders have not existed. Use of the present invention can provide an essential escape route to escape from the horrors of a fire.

SUMMARY OF THE INVENTION

The present invention provides a usable skylight with a means of providing a readily accessible emergency escape route.

The present invention is relatively inexpensive and may be readily used on new homes and homes with existing skylights.

Briefly, in accordance with the present invention, a skylight is provided with a housing for mounting on the roof of a dwelling in a conventional manner. The skylight is provided with a cover having at least a substantial portion thereof constructed of a transparent material. The cover is hingably attached to the housing. The cover is resiliently biased towards the open position. A latch means is used to retain the cover in the normally closed position. Upon release of the latch means, the cover may be easily opened, or depending upon the amount of resilient biasing force, may be opened automatically without further manual effort. A shock absorber means is provided to provide a dampening force for the cover movement. A retractable ladder is mounted at least partially to the sidewalls of the skylight housing. The retractable ladder may be extended easily in the case of an emergency. The retractable ladder is normally retained in the retracted position out of the way by means of a ladder latching means.

In one preferred embodiment of the invention, the ladder may be comprised of ladder rungs mounted on a flexible ladder rung support means. The flexible ladder rung support means may be retracted by the use of a pulley system with a latching means to retain the flexible ladder in the retracted position.

Alternatively, in another embodiment, the ladder may be comprised of a plurality of rigid sections hingably connected together. The ladder may be folded into a retracted position and retained in that position by a ladder retaining means. The ladder may be extended to a substantially linear position for escape in an emergency.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figures 1, 2:
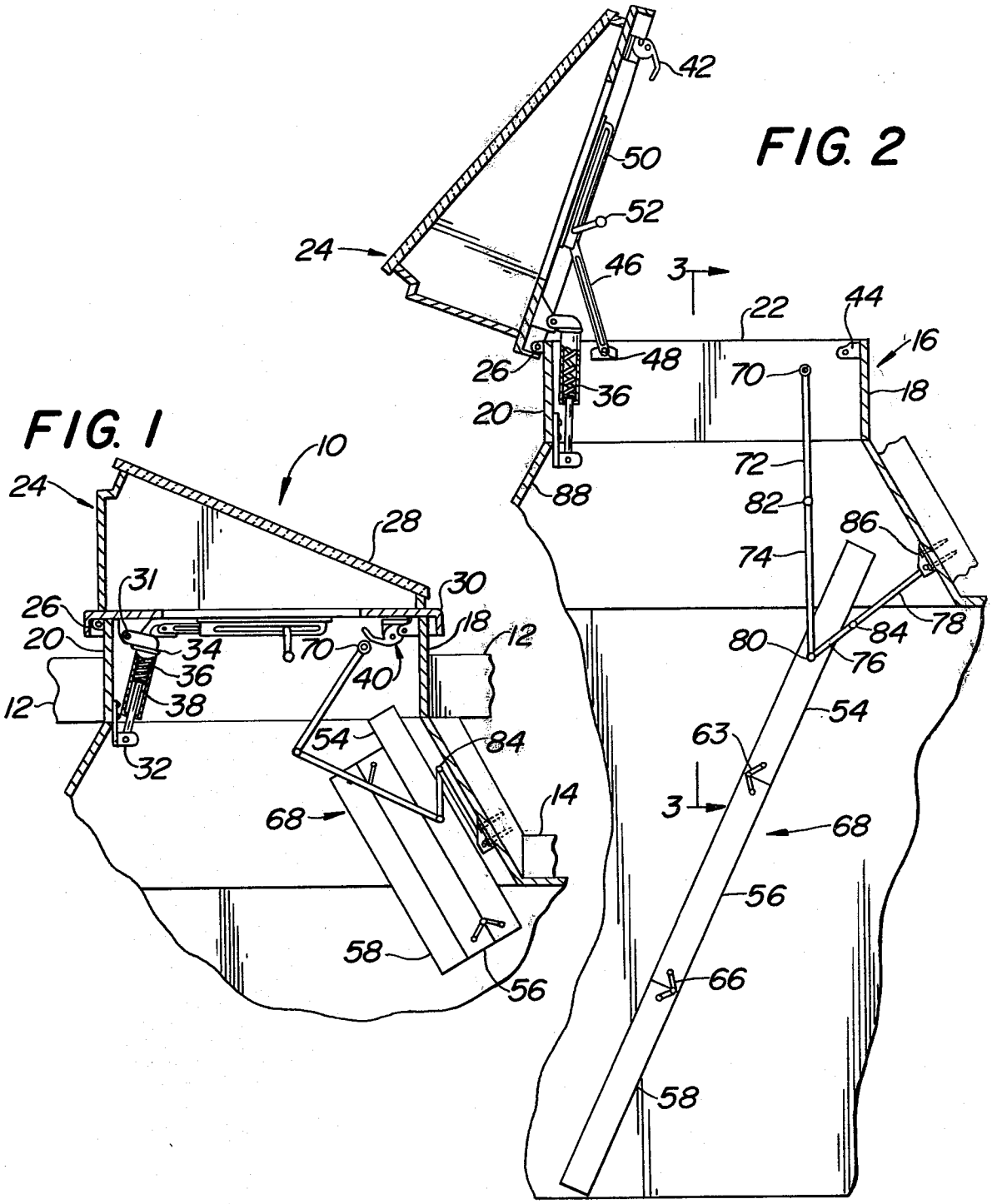
FIG. 1 is a side elevation view, partially in cross-section, of one embodiment of an emergency escape openable skylight in accordance with the present invention.
FIG. 2 is a side elevation view, partially in cross-section, of the emergency escape openable skylight shown in FIG. 1 with the emergency escape opened and the ladder means extended.

Referring now to the drawings in detail wherein like numerals indicate like elements, there is shown in FIG. 1 an emergency escape openable skylight 10 in accordance with the present invention. The emergency escape openable skylight 10 is conventionally mounted through a roof structure 12 and a ceiling structure 14. As is conventional, there is usually a space between the roof structure 12 and the ceiling structure 14.

The emergency escape openable skylight 10 is comprised of a housing 16 having sidewalls 18, 20 and 22. The housing 18 may be of a rectangular shape or any other suitable shape. As shown in cross-section in FIGS. 1 and 2, the sidewall opposite sidewall 22 is not shown, but is understood to exist. An openable cover structure 24 is hingably mounted by hinge 26 to sidewall 20 of housing 16. Cover 24 is provided with a transparent member 28. Transparent member 28 may be made from a glass plate, a transparent plastic material or any other suitable transparent material. The transparent member 28 may cover the entire upper surface of cover 24 or it may be mounted into a smaller area in a frame like structure. Cover 26 is also provided with a flange 30 around its lower outer edge which assists in the function of a weather tight seal.

Connected to the cover structure 24 at point 31 and to housing 16 by means of bracket 32 is a spring biased shock absorber 34. Spring biased shock absorber 34 is shown in FIGS. 1 and 2 with its housing partially broken away. Spring biased shock absorber 34 contains a coil spring 36 which applies an upward pressure to pivot point 30 causing cover 24 to be biased toward the open position as shown in FIG. 2. The coil spring 36 is shown in its extended position in FIG. 2. The spring applies a force between the housing of the shock absorber 34 and the piston 38 which is pivotally connected to bracket 32. The shock absorbing force created by the movement of piston 38 within the housing of shock absorber 34 is well known and need not be described here in detail. Furthermore, although a coil spring within housing 34 has been disclosed as a preferred embodiment, it is understood that the coil spring may be mounted in a different manner, such as over the outside of the housing of the shock absorber 34, or that other types of biasing structures may be used including various other types of springs, such as leaf springs and torsion bar arrangements.

Spring biased shock absorber 34 applies an upward bias force to cover 24 which either, depending upon the spring force, causes the cover 24 to open automatically upon the release of latch 40 or to at least assist in the raising of cover 24 so that the cover may be easily opened by even a relatively weak person, such as a child or a person already weakened by inhalation of smoke. Latch 40 may be any suitable type of latching structure which holds the cover secure when latched, but easily and quickly unlatches by pivoting member 42 on cover 24. Member 42 engages latch element 44 mounted on sidewall 18 of housing 16.

The shock absorbing function of spring biased shock absorber 34 provides a dampening function when the door is opened to prevent excessive jarring of the structure on the hinge, and even more importantly, it provides a dampening function when the cover 24 is pushed or pulled closed into engagement with the housing 16. Bar 46 which is pivoted at point 48 to sidewall 22 is slideably connected by means of slideway 50 to cover 24 and prevents opening of the cover beyond a predetermined amount in order to prevent the cover 24 from flapping back over onto the roof. This prevents damage to the cover 24 and the roof, and makes the operation thereof easier. Bar 46 is provided with a handle 52 which may be used in closing cover 24.

Figure 3:
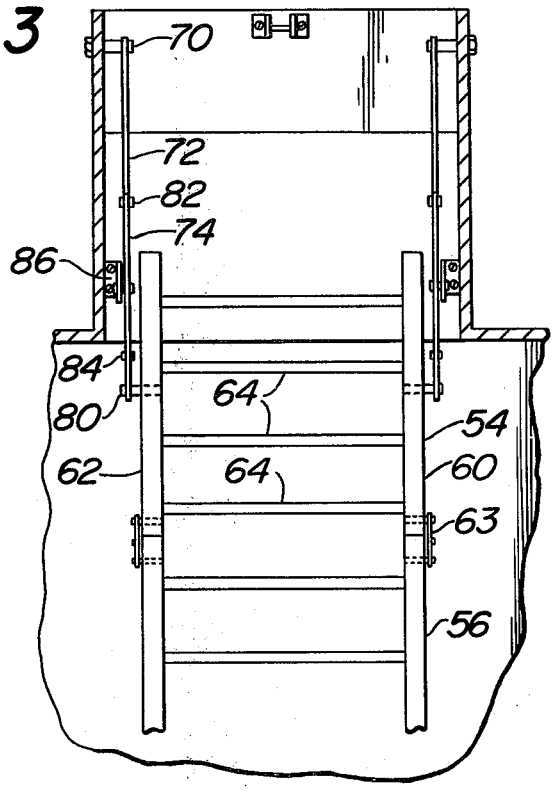
FIG. 3 is a view partially in cross-section taken along line 3—3 of FIG. 2 of an emergency escape openable skylight in accordance with the present invention.

The emergency escape openable skylight 10 is provided with a retractable ladder means mounted at least partially to the housing. As shown in FIGS. 1, 2 and 3, the retractable ladder is comprised of a plurality of rigid ladder sections 54, 56 and 58. As may be seen in FIG. 3, rigid ladder section 54 is comprised of rails 60 and 62 with ladder rungs 64 connected therebetween. The ladder sections are hingably connected together by hinge joints 64 and 66 which allow folding in only one direction. In other words, the ladder may be folded as shown in FIG. 1, but when extended as shown in FIGS. 2 and 3, the hinges 63 and 66 interact with the rails of the ladder to prevent folding in the opposite direction, thereby forming a rigid ladder. Although the foldable rigid ladder 68 takes up some space in its folded position as shown in FIG. 1, in its extended position it is easy to climb even for a weak or weakened person. The ladder 68 is mounted to the housing 16 at point 70 by means of a folding bar arrangement comprised of bars 72, 74, 76 and 78. The folding bar arrangement is connected to ladder section 54 at pivot point 80. Bar 72 is connected to bar 74 at pivot point 82. Bar 76 is connected to bar 78 at pivot point 84. Bar 78 is pivotally connected by means of brackets 86 to the ceiling well 88. The folding bar structure comprised of bars 72, 74, 76 and 78 enables the folding of the ladder sections 54, 56 and 58 to a position substantially parallel to the sidewall of the ceiling well and substantially out of the light path through transparent member 28. The ladder may also be folded so as to not project substantially below the ceiling and enables free passage underneath the emergency escape openable skylight 10 when an emergency escape is not in progress.

Figure 4:
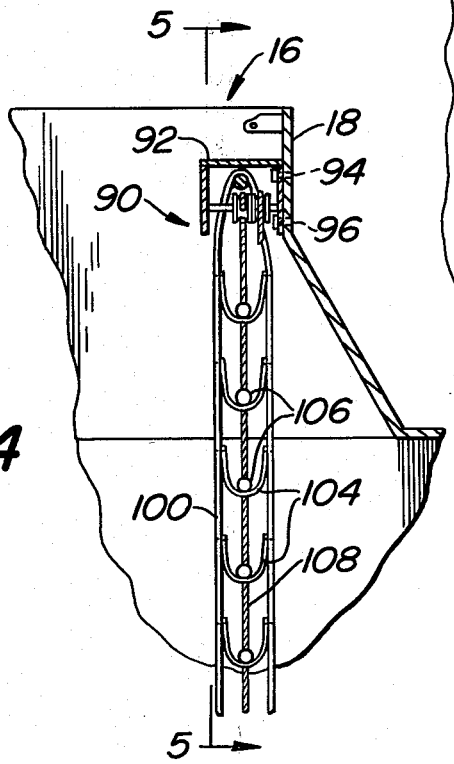
FIG. 4 is a broken out view of another embodiment of an emergency escape openable skylight, partially in cross-section, showing a retractable ladder means in accordance with the present invention.
Figure 5:
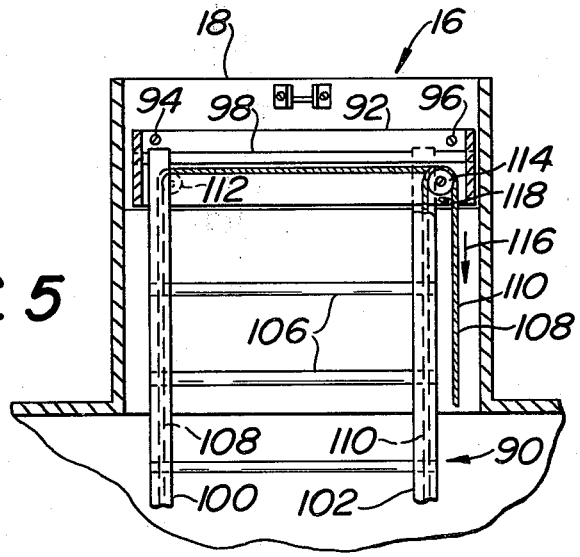
FIG. 5 is a view taken along line 5—5 of FIG. 4 of the retractable ladder means of FIG. 4 in accordance with the present invention.

Referring now to FIGS. 4 and 5, there is shown another embodiment of a retractable ladder 90 in accordance with the present invention. Retractable ladder 90 is a flexible ladder which may be raised by a rope and pulley arrangement when not in use. As shown in FIGS. 4 and 5, the ladder structure is mounted to sidewall 18 of housing 16 by means of ladder housing structure 92 which may be bolted to sidewall 18 by bolts 94 and 96. The flexible ladder structure 90 is supported by a bar 98 mounted to ladder housing 92. The flexible ladder 90 is comprised of a pair of flexible ladder rails 100 and 102 mounted on support bar 98. Flexible rails 100 and 102 may be double flexible rails as shown in FIG. 4 with straps 104 connected across the two to support rigid ladder rungs 106. In the fully extended position, the flexible ladder rails 100 are supported by bar 98 which in turn supports the straps 104 and the ladder rungs 106 in spaced relationship. When it is desired to retract the flexible ladder 90 into its storage position, the ropes 108 and 110, which are fastened to the bottom ladder rung 106, are pulled over pulleys 112 and 114 by pulling on cords 108 and 110 in the direction of arrow 116. Pulley 112 may be a single pulley and pulley 114 may be a double pulley allowing the passage of ropes 108 and 110 thereover. When the flexible ladder 90 is fully retracted to its upward position against housing 92, the ropes 106 and 108 may be locked in that position by causing the ropes 108 and 110 to engage a dog or latching means 118 in the housing 92.

The present invention may be embodied in other specific forms without departing from the spirit or essential attributes thereof and, accordingly, reference should be made to the appended claims, rather than to the foregoing specification as indicating the scope of the invention.

We claim:

1. A skylight usable as an emergency escape route, comprising: a housing having sidewalls; a cover, a substantial area of said cover being constructed of a transparent material; a hinge attaching the cover to one of the sidewalls of said housing; means for resiliently biasing said cover to the open position; latch means for maintaining said cover in a normally closed position against the force of said resilient biasing means; shock absorber means mounted between said cover and said housing for dampening the motion of said cover; and retractable ladder means mounted at least partially to said housing, said retractable ladder means including a plurality of rigid ladder rungs supported in the extended position by a flexible ladder rung support means having ladder rung supports at predetermined ladder rung positions, said flexible ladder rung support means being comprised of a pair of flexible ladder rails, each ladder rail being comprised of a pair of parallel flexible straps, said rung supports being comprised of flexible straps interconnecting said parallel flexible straps, a pully arrangement in said retractable ladder means including ropes passing over the pulley arrangement for raising and lowering said flexible ladder rung support means, said retractable ladder means being maintained by ladder latching means in a normally retracted position and being openable to an extended position for emergency exit through the skylight when said cover is in the open position.

* * * * *